United States Patent [19]

Brotherton

[11] Patent Number: 4,679,763

[45] Date of Patent: Jul. 14, 1987

[54] CONCRETE FORM HAVING ADJUSTABLE CURVATURE AND METHOD FOR PRODUCING SAME

[75] Inventor: Thomas W. Brotherton, Des Moines, Iowa

[73] Assignee: Economy Forms Corporation, Des Moines, Iowa

[21] Appl. No.: 768,201

[22] Filed: Aug. 22, 1985

[51] Int. Cl.[4] ..... E04G 9/02

[52] U.S. Cl. ..... 249/189; 29/526 R; 249/17; 249/155; 264/32

[58] Field of Search ..... 249/17, 48, 26, 209, 249/8, 2, 20, 189, 192, 194, 10, 11, 155; 264/32; 425/63; 29/526 R, 445, 155 R

[56] References Cited

U.S. PATENT DOCUMENTS

| | | | |
|---|---|---|---|
| 877,768 | 1/1908 | Head | 249/159 |
| 883,194 | 3/1908 | Guthrie | 249/20 |
| 965,979 | 8/1910 | Young | 249/2 |
| 1,229,163 | 6/1917 | Stieler | 249/17 |
| 1,350,772 | 8/1920 | Belt et al. | 264/32 |
| 2,046,123 | 6/1936 | Jennings | 249/195 |
| 2,151,210 | 3/1939 | Jennings | 249/195 |
| 2,197,318 | 4/1940 | Rumble | 52/805 |
| 2,436,543 | 2/1948 | Blaski | 52/521 |
| 2,616,148 | 11/1952 | Hawes | 249/18 |
| 2,793,720 | 5/1957 | Hawes | 249/155 |
| 2,933,056 | 4/1960 | Martin | 52/82 |
| 3,971,176 | 7/1976 | Rannels | 52/86 |

OTHER PUBLICATIONS

"Form Marks", sales brochure of Economy Forms Corporation, Des Moines, Iowa, Winter 85/86.

*Primary Examiner*—Jay H. Woo
*Assistant Examiner*—James C. Housel
*Attorney, Agent, or Firm*—Rudolph L. Lowell

[57] ABSTRACT

The metal form has a flexible panel member with a perimetral flange projected laterally from one side thereof. Each of a pair of transversely opposite side sections of the flange is segmented by a plurality of longitudinally spaced V-shaped notches having their apices adjacent the one side of the panel member to provide for a lateral flexing movement of the panel member to a preselected shape. With the panel member in the predetermined shape, the segments in each of the flange side sections are connected together against relative movement to retain the predetermined shape of the panel member.

6 Claims, 7 Drawing Figures

10
11
12
13
14
16
17
18
19
19a
19b
21
22
23
23a
24
26b
27

FIG. 3
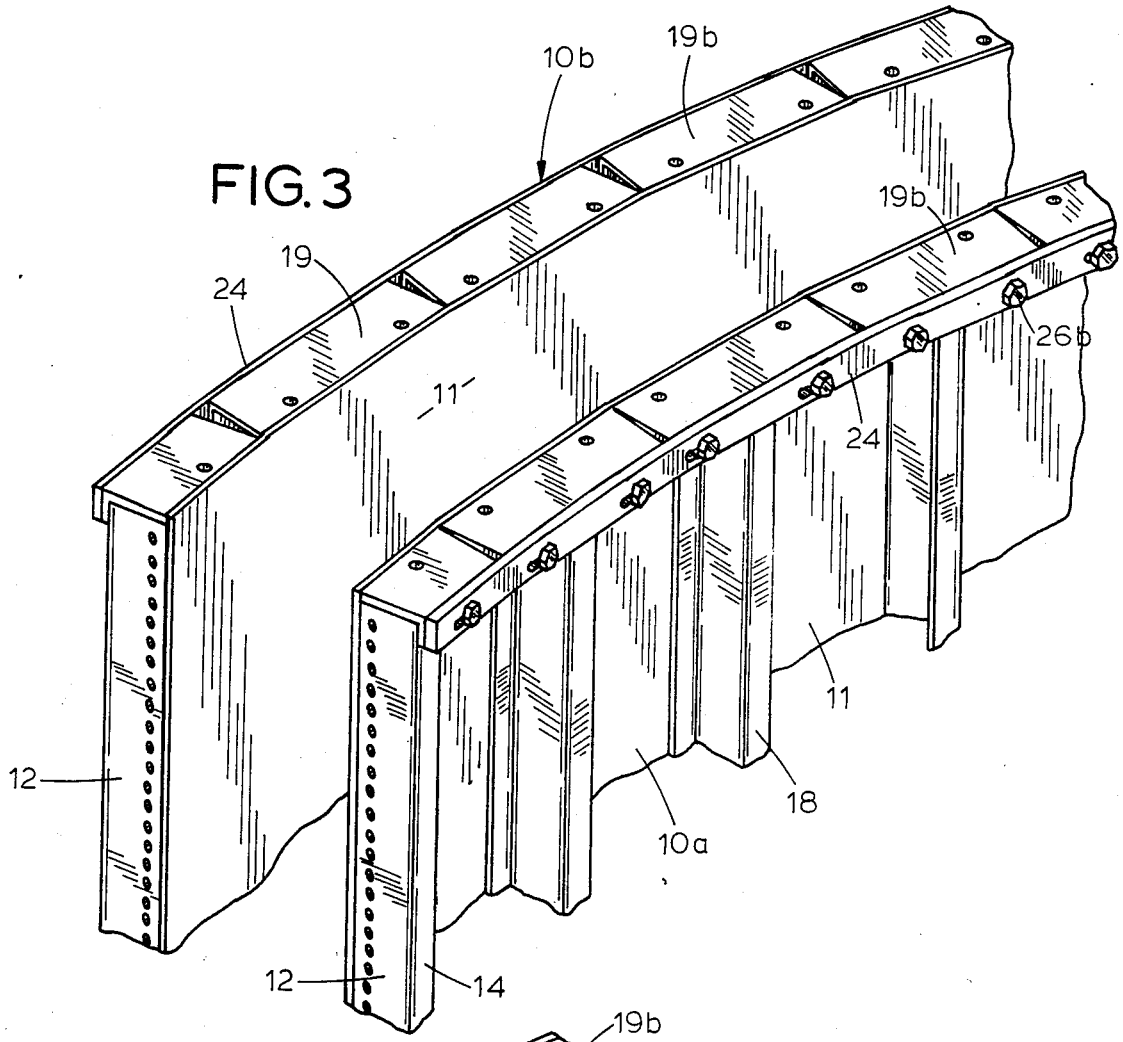
FIG. 4
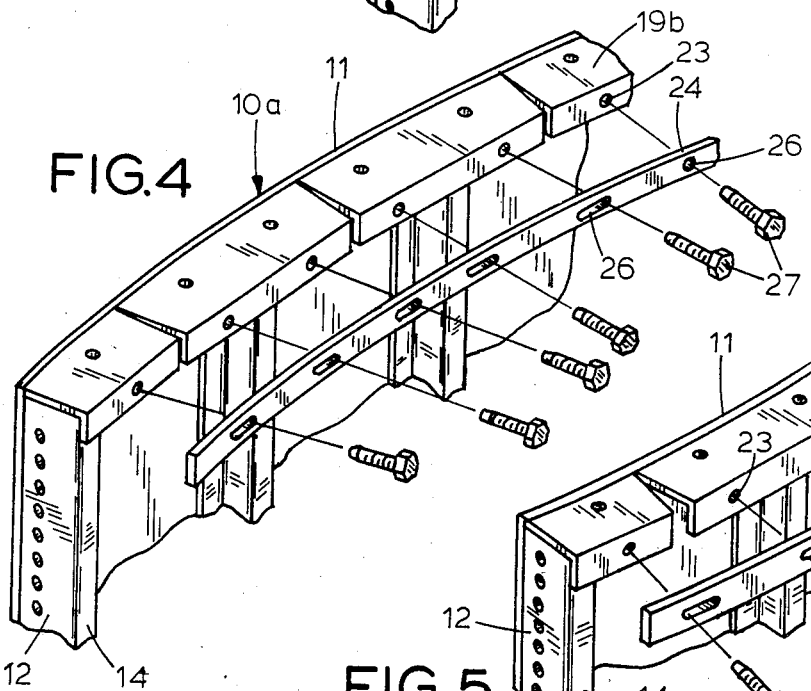
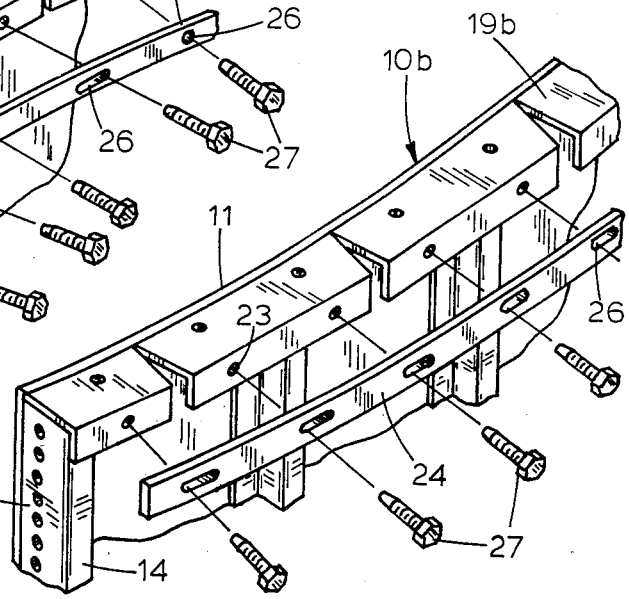
FIG. 5

CONCRETE FORM HAVING ADJUSTABLE CURVATURE AND METHOD FOR PRODUCING SAME

BACKGROUND OF THE INVENTION

Concrete construction forms are generally prefabricated by the manufacturer for use in a particular structural application such as corner forms, linear wall forms, or form parts for assembly on the job to build structures having a curved surface and the like. Thus, in U.S. Pat. No. 2,616,148, a form assembly enables the casting of generally curved surfaces to a particular desired curvature by the use of flexible metal sheets arranged with their side portions in an overlapping relation and having reinforcing members at such side portions that are adjustably clamped to a supporting scaffold to secure the flexible sheets in the desired curved pattern to form an arched roof. Arched roof constructions are also shown in U.S. Pat. Nos. 2,436,543 and 2,933,056.

U.S. Pat. No. 3,971,176 discloses a permanently formed wooden stud-truss that has a curved central arch section positioned between a pair of straight end sections. The central arch has transverse slots or notches the sides of which are moved into contact engagement to provide the desired curvature. Before being closed the slots are filled with an adhesive compound to maintain the central arch in permanent deflection.

SUMMARY OF THE INVENTION

The invention provides a concrete metal form that is transportable as a unit and may be adjusted for use in the construction of concrete structures having either planar or curvital surfaces, or a combination of such surfaces. The form is easily and quickly convertible on the job for such applications to appreciably reduce manufacturing, handling and storage costs by the elimination of a plurality of special job forms. The form has a flexible metal panel member with an integral perimetral flange and ribs projected laterally from one side. A pair of transversely opposite side sections of the perimetral flange are divided into a plurality of segments by longitudinally spaced V-shape notches the apices of which are adjacent the one side of the panel member, to provide for a lateral flexing movement of the panel member to a desired curved shape. This desired shape is obtained by placing the form on a fixture or jig with the opposite side of the panel member against a predetermined curve surface on the fixture. With the panel member flexed against the curved surface, the segments in each of the flange sections are rigidly but releasably connected together against relative movement by a retaining or tension strap to maintain the predetermined curved shape of the flexed panel member. The form is then removed from the fixture for use. As a result of the notch separation of the flange segments and the releasable connection of the segments to hold a predetermined curved shape of the panel member, the form may be readily converted from a curvital shape to a planar shape, and vice versa, or to a combination of such shapes as dictated by the job requirements.

BRIEF DESCRIPTION OF THE DRAWINGS

FIG. 3 is a fragmentary perspective view illustrating the use of a pair of the metal concrete forms to build a wall structure having a curvital surface;

FIG. 4 is an enlarged detail exploded perspective view of one of the forms in FIG. 3 to more clearly illustrate its construction;

FIG. 5 is illustrated similarly to FIG. 4 and shows the other form in FIG. 3;

DESCRIPTION OF A PREFERRED EMBODIMENT

Figure 1:
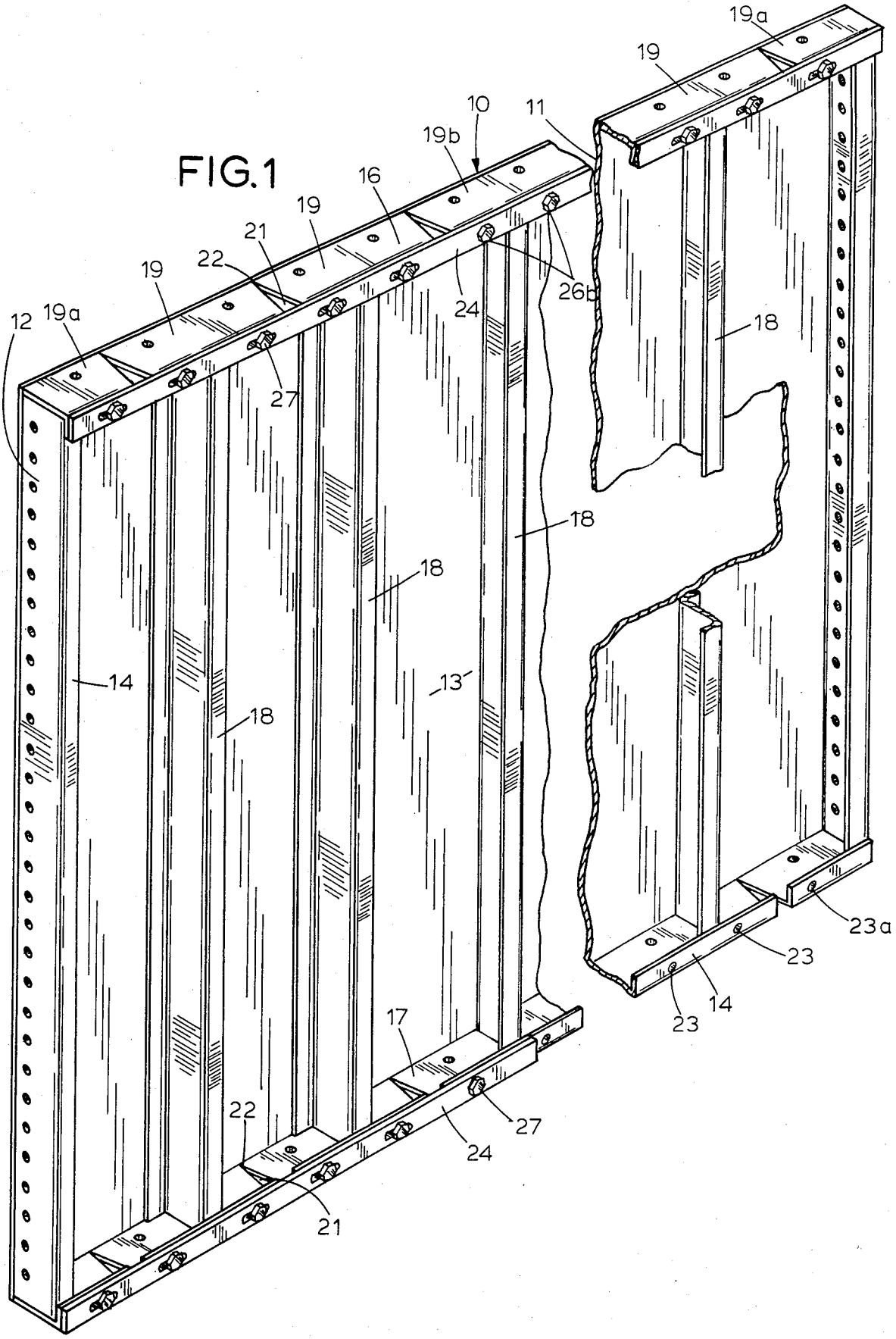
FIG. 1 is a foreshortened rear perspective view of the metal concrete form of this invention, with parts removed for clarity, showing its use for forming a concrete structure having a planar surface.

Referring to FIG. 1 of the drawings, there is shown a metal concrete form 10 of a generally pan shape having a panel member 11 with a perimetral flange 12 projected laterally from one side 13 thereof. The flange 12 has a terminal flat surface portion or projection 14 in a parallel relation with the panel member 11. Spaced longitudinally of a pair of transversely opposite side sections 16 and 17 of the flange 12 and extended therebetween in a parallel spaced relation are a plurality of brace members 18 each of which is secured as by weldments to the one side 13 of the panel member 11. As shown in FIG. 1, each brace member is of a height substantially equal to the height of the flange 12 with its opposite ends underlying the terminal projections 14 on the flange side sections 16 and 17. As thus far described, the metal concrete form 10 is commercially available for planar surface concrete structures.

For the purpose of converting the form 10 to on-site use in the construction of concrete structures having either planar or curvital surfaces, each of the side flange sections 16 and 17 is divided into a plurality of segments 19 by V-shape notches 21 having their apices 22 adjacent the side 13 of the panel member 11 and each of which is located between adjacent brace members 18. Each end segment **19*a* is formed with a single hole 23*a* and each remaining segment 19 with a pair of longitudinally spaced holes 23**.

The panel member 11 is formed from a sheet steel material so as to be bendable laterally of the form 10 at the notches 21 from the planar position illustrated in FIG. 1 to the reversely curved positions illustrated in FIG. 3. The planar shape of the panel member 11 in FIG. 1, in the construction of concrete structures having planar surfaces is maintained, by a tension or flat strap member 24 formed with longitudinally spaced openings 26 and **26*a* for alignment with associated holes 23 and 23*a* in the segments 19 and 19*a*, respectively, of the flange sections 16 and 17. Bolt assemblies 27 insertable through the aligned ones of the holes 23 and 23*a* and openings 26 and 26*a* on being tightened lock the segments 19 and 19*a* in each flange section against relative movement whereby to maintain the planar adjustment of the panel member 11**.

Figure 2:
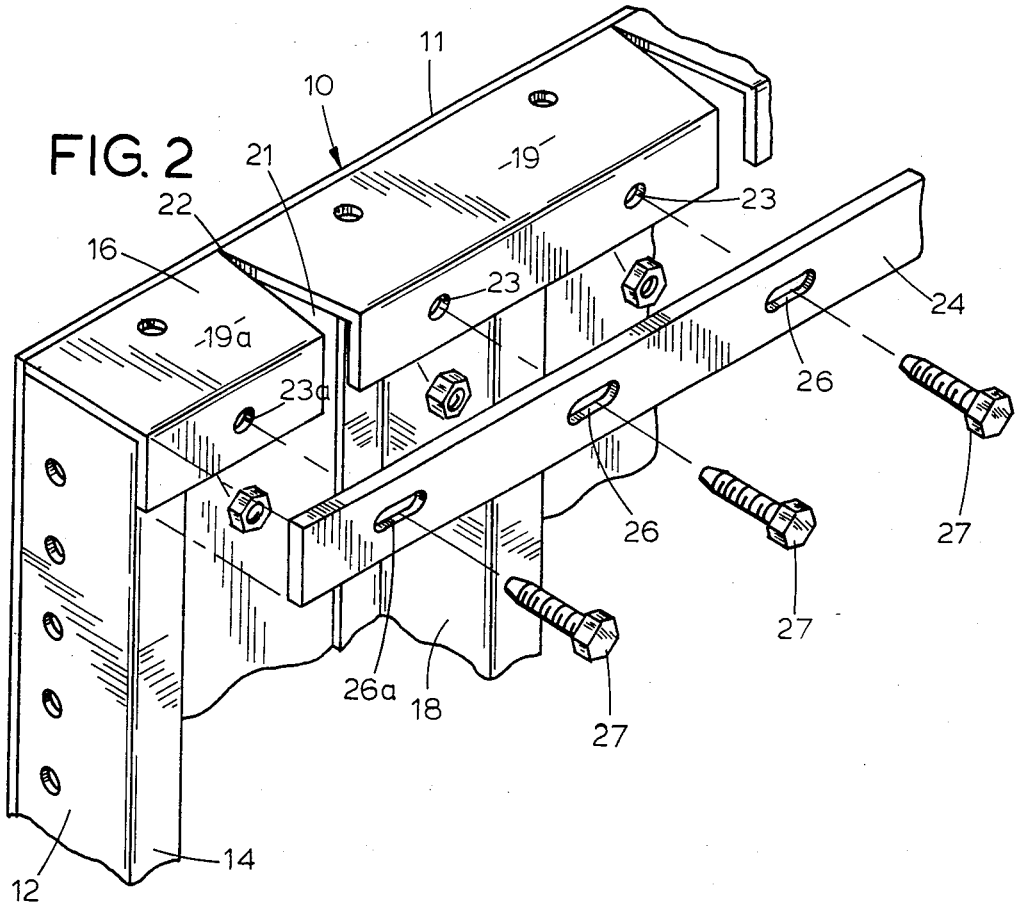
FIG. 2 is an enlarged detail exploded perspective view of the metal concrete form in FIG. 1 showing the assembly relation of a tension member with the panel member of the form.

When the form 10 is to be used to build a concrete structure having a curvital surface, the tension member 24 is released from its segment locking position by loosening of the bolt assemblies 27 to provide for its repositioning with respect to the flange sections 16 and 17. As shown in FIGS. 1 and 2, the openings 26 in the tension member 24 are of an elongated shape in a direction longitudinally of the tension member except for a pair of the openings 26*b* that are located centrally of the tension member (FIG. 1).

Figure 6:
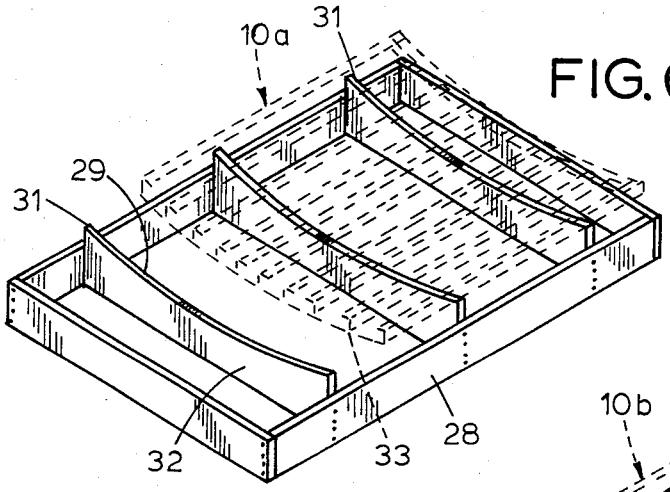
FIG. 6 is a diagrammatic showing of a fixture providing for a predetermined curvital shape of the form panel member.

To curve the panel member 11 convexly, as illustrated for the form 10*a* in FIG. 3, the form, with the tension member 24 released, is placed upon a fixture 28, normally of a wooden construction, and having a predetermined concave surface 29 comprised of individual aligned curved surfaces 31 formed on beam members 32 of fixture 28 (FIG. 6). With the form 10 on the fixture 28 and the panel member side 33 against the concave surface 29, the panel member generally under the weight of the form alone will take on the predetermined shape of the curved surface 29. In one embodiment of the invention, the sheet metal forming the panel member 11 and the perimetral flange 12 have a thickness of about 3/16 inch. The brace members 18 are also formed from a 3/16 inch sheet metal material so that the form 10 has an average weight of about twenty pounds per square foot. This weight is generally sufficient to conform the panel member 11 to the curved surface 29 without the application of any additional weight or pressure.

With the form 10 thus positioned on the fixture 28, the bolt assemblies 27 at the central holes 26*b* in the strap member 24 are initially tightened. Following this initial assembly of the tension member with the form, the bolt assemblies 27 for the adjacent segment to each side of the center segment 19*b* are tightened and this alternate bolt tightening procedure to each side of the center segment is continued until all bolt assemblies have been initially adjusted. Following this initial adjustment of the bolt assemblies, all of the bolt assemblies are then torqued uniformly to about 200 foot pounds. By virtue of the elongated shape of the openings 26 in the tension member 24, movement of the tension member relative to the bolt assemblies fixed in the holes 23 in the flange section 16 and 17, is permitted to accommodate the curvital shape of the panel member 11.

Figure 7:
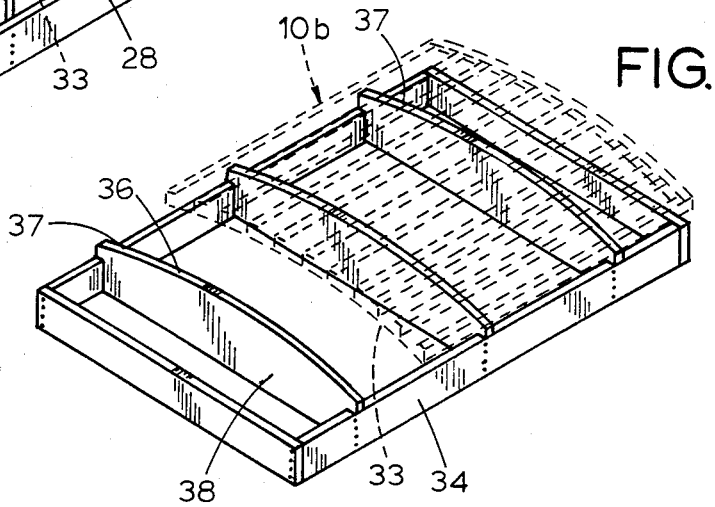
FIG. 7 is illustrated similarly to FIG. 5 and shows a fixture for curving the panel member to a curvital shape reversed relative to its curvital shape of FIG. 6.

In the adjustment of the form 10 to its curved shape shown in FIG. 3 at 10*b*, the procedure is similar to that followed in the curvital shaping of the form 10*a*. In this respect the fixture 34 (FIG. 7) has a predetermined curved surface 36 of a convex shape formed by the aligned curved surfaces 37 on the beams 38 of the fixture 34. With the tension member 24 relaxed, relative to the flange side sections 16 and 17, the form 10 is placed on the fixture 34 with the side 33 of the panel member 11 against the predetermined curved surface 36. Similarly to the procedure described in connection with FIG. 6, the center bolt assemblies 27 are initially tightened, after which the bolt assemblies to each side thereof are alternately tightened and then finally uniformly torqued to about two hundred foot pounds.

It is seen, therefore, that in adjusting the form 10 for planar surface structures, the bolt assemblies 27 are positioned substantially centrally of the elongated openings 26 in the tension member 24 (FIG. 2) and that when the panel member 11 is adjusted to curvital reverse positions thereof, the bolt assemblies 27 are at one or the other of the ends of the longitudinal openings 26 (FIGS. 4 and 5). The radius of a curvital surface will be limited by the contact engagement of opposite side portions of the notches 21 which are of a size to permit generation of predetermined curved surfaces about radii of twenty feet and greater. It is apparent that to convert the form 10 from a curvital shape to a planar shape the tension member 24 is relaxed and the panel member side 33 positioned against an available flat surface, after which the tension member is rigidly secured to the flange side sections 16 and 17. Although a metal concrete form has been described in detail, it is to be understood that the invention is equally applicable to a fiberglass form or to a wooden form wherein the panel members are bendable and the perimetral flange thereon is notched and then tensioned to a desired shape by a strap or tension member 24.

Although the invention has been described with respect to a preferred embodiment thereof, it is to be understood that it is not to be so limited since changes and modifications can be made therein which are within the full intended scope of this invention as defined by the appended claims.

I claim:

1. A concrete form having a flexible panel member with an upstanding perimetral flange projected laterally from one side thereof and wherein said flange has a pair of transversely opposite side sections disposed on opposite ends of said form each of which side sections has a flat terminal surface portion extended inwardly in a direction parallel to said one side of the form, the improvement wherein:

(a) each of said opposite flange side sections is divided into a plurality of segments by a plurality of notches longitudinally spaced over the length thereof, with each notch terminating in a V-shape portion having the apex thereof adjacent said one side of the panel member whereby said panel member is laterally flexibly movable to a preselected generally curve shape, and (b) means secured to the terminal surface portions of said flange segments to maintain the pre-selected curved shape of said panel.

2. The concrete form, according to claim 1, including:

(a) a plurality of brace members spaced longitudinally of and extended between and connected to said opposite flange side sections with each brace member located between adjacent ones of said notches.

3. The concrete form according to claim 1, wherein:

(a) said means comprises a bendable metal strap member for each of said opposite flange sections positioned back to back against the terminal surface portions of said flange section segments.

4. A concrete form having a flexible panel member with an upstanding perimetral flange projected laterally from one side thereof and wherein said flange has a pair of transversely opposite side sections disposed on opposite ends of said form each of which has a terminal portion, projected inwardly in a direction parallel to said one side of the form, the improvement wherein:

(a) each of said opposite flange side sections is divided into a plurality of segments by a plurality of notches longitudinally spaced over the length thereof, with each notch terminating in a V-shape portion having the apex thereof adjacent said one side of the panel member whereby said panel member is laterally flexibly movable to a preselected generally curve shape, (b) a bendable metal strap member for each of said opposite flange sections positioned back to back against the terminal portions of said flange section segments, (c) with each segment of each of said opposite flange sections having longitudinally spaced round holes in the terminal portion thereof, and each of said metal strap members having a pair of centrally located longitudinally spaced round holes and a plurality of elongated longitudinally spaced holes to each side of said pair of round holes corresponding to the holes in said segments, and (d) bolt means extendible through associated holes in said terminal portions and in said strap members for retaining the panel in the preselected curved shape.

5. The method of providing a concrete form to form a concrete structure having either a planar or a curvital surface wherein the form has a flexible panel member with an upstanding perimetral flange projected laterally from one side thereof comprising the steps of:

(a) forming a pair of transversely opposite side sections of said flange with longitudinally spaced notches having V-shaped portions the apices of which are adjacent the one side of the panel member to form separated flange segments providing for a lateral flexible movement of the panel member, (b) forming each of said transversely opposite side sections with a terminal laterally projected flat surface portion, (c) flexing the panel member to a preselected planar or curved shape, and (d) connecting the terminal surface portions of the segments of each of said flange opposite side sections against relative movement to retain the panel member in the preselected shape.

6. The method of providing a metal concrete form to form a concrete structure having either a planar or a curvital surface wherein the form has a flexible metal panel member with an upstanding perimetral flange projected laterally from one side thereof comprising the steps of:

(a) forming a pair of transversely opposite side sections of said flange with longitudinally spaced notches having V-shaped portions the apices of which are adjacent the one side of the panel member to form separated flange segments providing for a lateral flexible movement of the panel member, (b) forming each of said opposite side sections with a flat terminal surface portion projection inwardly of the form, (c) providing a fixture with a surface of a preselected planar or curved shape, (d) positioning the metal form on said fixture with the other side of the panel member opposite said surface, (e) flexing the panel member against said surface in conformance with the preselected shape of said surface, (f) connecting the terminal portions of the flange segments of each of said flange side sections against relative movement, while the panel member is flexed against said surface to retain the panel member in the preselected shape of the surface, and then (g) removing the form from the fixture.

* * * * *